US007707669B1

(12) United States Patent
Richardson

(10) Patent No.: US 7,707,669 B1
(45) Date of Patent: May 4, 2010

(54) MATTRESS LIFT

(75) Inventor: Barrie Richardson, Orlando, FL (US)

(73) Assignee: BBE R&D L.L.C., Orlando, FL (US)

( * ) Notice: Subject to any disclaimer, the term of this patent is extended or adjusted under 35 U.S.C. 154(b) by 0 days.

(21) Appl. No.: 12/380,653

(22) Filed: Mar. 2, 2009

(51) Int. Cl.
*A47C 31/00* (2006.01)

(52) U.S. Cl. ..... 5/660; 5/658; 5/659

(58) Field of Classification Search ..... 5/660, 5/658, 659, 509.1, 488, 692
See application file for complete search history.

(56) References Cited

U.S. PATENT DOCUMENTS

| | | | | |
|---|---|---|---|---|
| 6,886,203 | B2 * | 5/2005 | Drakos et al. | 5/660 |
| 7,581,270 | B1 * | 9/2009 | Levesque | 5/660 |
| 2004/0133985 | A1 * | 7/2004 | Drakos et al. | 5/658 |
| 2008/0222814 | A1 * | 9/2008 | Jaeger | 5/658 |

* cited by examiner

*Primary Examiner*—Robert G Santos

(74) *Attorney, Agent, or Firm*—Arthur W. Fisher, III

(57) ABSTRACT

A mattress lift for elevating a bed mattress and tucking in sheets or bed covers beneath or under the bed mattress between the bed mattress and a box spring or other supporting surface comprising a lift device including a base or body having a longitudinally disposed substantially oblong recess formed in the upper surface thereof with a longitudinally disposed oblong slot formed in the base or body symmetrically disposed within the longitudinally disposed substantially oblong recess, a lift handle formed or coupled to a proximal portion of the base or body configured to be grasped by the user, a lift ramp including an inclined surface formed or coupled to a distal portion of the base or body configured to slide between the bed mattress and box spring to tuck the sheets or bed covers therebetween and a lift support device including an upper lift coupler movably or slidably disposed within the longitudinally disposed substantially oblong recess interconnected or coupled to a lower lift support member disposed beneath the base or body by an interconnecting member at least partially disposed within the longitudinally disposed oblong slot movable or slidable from the proximal end of the longitudinally disposed oblong slot to a distal end of the longitudinally disposed substantially oblong slot to support the lift device in an elevated position to hold the side edge portion and end edge portion of the bed mattress in spaced relationship relative to box spring or support.

18 Claims, 6 Drawing Sheets

MATTRESS LIFT

BACKGROUND OF THE INVENTION

1. Field of the Invention

A device and method for lifting a bed mattress and tucking in sheets or bed covers beneath or under the bed mattress.

2. Description of the Prior Art

Changing bed linens and blankets require a degree of strength, dexterity and mobility. This is particularly true for housekeepers who change bed linens on many beds every day, such as in hotels, hospitals and long term care facilities. The task of repeatedly lifting portions of mattresses is physically demanding on the housekeeper and is exacerbated if an institution chooses to use larger or heavier mattresses and bedclothes. Thus, the physical challenges of changing bed linens can be a difficult problem in the homes of many people, and housekeeping staff back, neck, shoulder, elbow, wrist, and finger joint injuries due to the changing of bed linens are a significant workplace issue.

It is therefore desirable to have methods and apparatus to render the task of changing bedclothes less physically demanding. Numerous efforts have been undertaken to reduce these demands.

U.S. Pat. No. 7,398,569 discloses an apparatus for lifting bed mattresses and tucking in bed covers comprising a wedge for lifting bed mattresses.

U.S. 2007/0271706 shows a mattress lift device a wedge-shaped sloped section, a level support section and a handle, for elevating a section of a mattress over a support surface upon which the mattress is lying. A distal end of the sloped section to be directly inserted between the mattress and the support surface, while the proximal end of the sloped section has a height adequate to elevate the mattress high enough to aid in the changing of bedclothes.

U.S. U.S. 2008/0222814 relates to a device for vertically lifting an end of a horizontally disposed mattress comprising an elongated member disposed beneath the mattress and movable by a handle is disposed on and secured to one end of the elongated member between a resting position wherein the elongated member is disposed coplanar with a bottom surface of the mattress and a lifting position wherein the elongated member is disposed generally perpendicular to the bottom mattress surface for lifting the end of the mattress in the vertical direction. The handle is releasably secured to the end of the end of the elongated member for ease of securing the handle to an opposed end of the elongated member.

Additional examples of the prior art are found in; U.S. Pat. No. 2,381,509; U.S. Pat. No. 2,387,357; U.S. Pat. No. 2,390,660; U.S. Pat. No. 2,504,176; U.S. Pat. No. 3,021,533; U.S. Pat. No. 3,952,346; U.S. Pat. No. 4,181,989; U.S. Pat. No. 6,886,203 and U.S. Pat. No. 7,240,385.

SUMMARY OF THE INVENTION

The present invention relates to a mattress lift to elevate a bed mattress and to tuck in sheets or bed covers between the bed mattress and a box spring or other support surface.

The mattress lift comprises a lift device and a lift support device.

The lift device comprises a base or body having a lift handle and a lift ramp formed or coupled at opposite end portions thereof.

The base or body includes an elongated recess formed in the upper surface thereof and an elongated slot formed through the base or body and disposed beneath the elongated recess in symmetrical registry or alignment therewith.

The lift handle comprises a reduced member to allow the user to grasp the lift handle.

The lift support device comprises an upper member disposed within the elongated recess movable or slidable between a proximal end and a distal end thereof interconnected to a lower lift support member disposed beneath the base or body by an interconnecting member at least partially disposed within the elongated slot movable or slidable between a proximal end and a distal end thereof.

In use, bed sheets or bed covers are placed or positioned on top of the bed mattress. Once the bed sheets or bed covers are positioned on the bed mattress, the user grasps the lift handle and inserts the lift ramp between the bed mattress and box spring or other support surface tucking the bed sheets or bed covers therebetween.

The mattress lift is then lifted or rotated upwardly while the lift support device is located or positioned generally at the proximal end of the base or body. When the mattress lift is in the elevated position, the lift support device is moved or slid downwardly from the proximal end of the base or body to the distal end with the upper member sliding along the recess and the interconnecting member sliding within the elongated slot as the lower lift support member moves along the bottom of the lift support.

Once the lift support reaches the distal end of the device, the user releases the mattress lift allowing the lower support member to rest on the box spring or support surface to support surface allowing the user to completely tuck in the bed sheets or bed covers.

Once completed, the lift support device is slid upwardly and the lift ramp of the mattress lift is removed or withdrawn from between the bed mattress and the box spring or support surface.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

As shown in FIGS. 1 through 6, the present invention relates to a mattress lift generally indicated as 10 to elevate a bed mattress 12 and to tuck in sheets or bed covers 14 beneath or under the bed mattress 12 between the bed mattress 12 and a box spring or other support surface 16.

Figure 2:
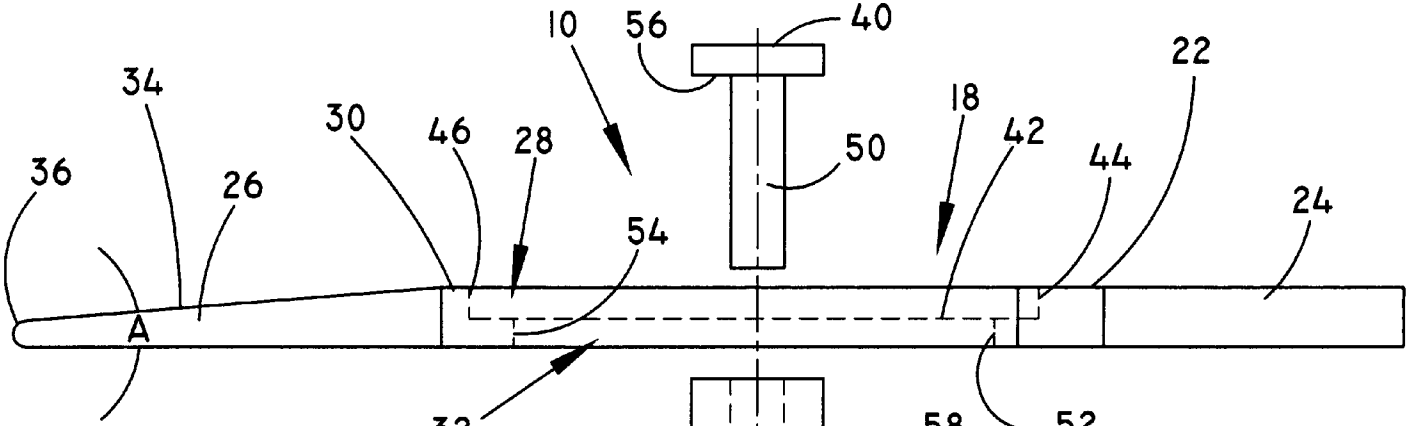
FIG. 2 is an exploded side view of the mattress lift of the present invention.
Figure 3:
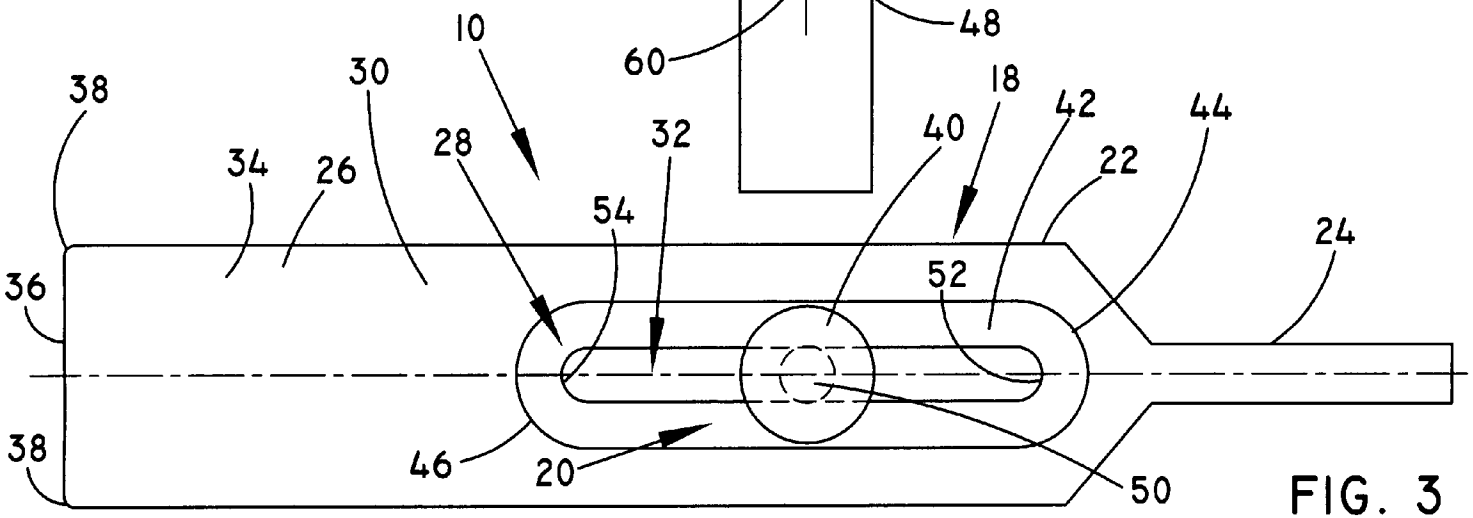
FIG. 3 is a top view of the mattress lift of the present invention.
Figure 4:
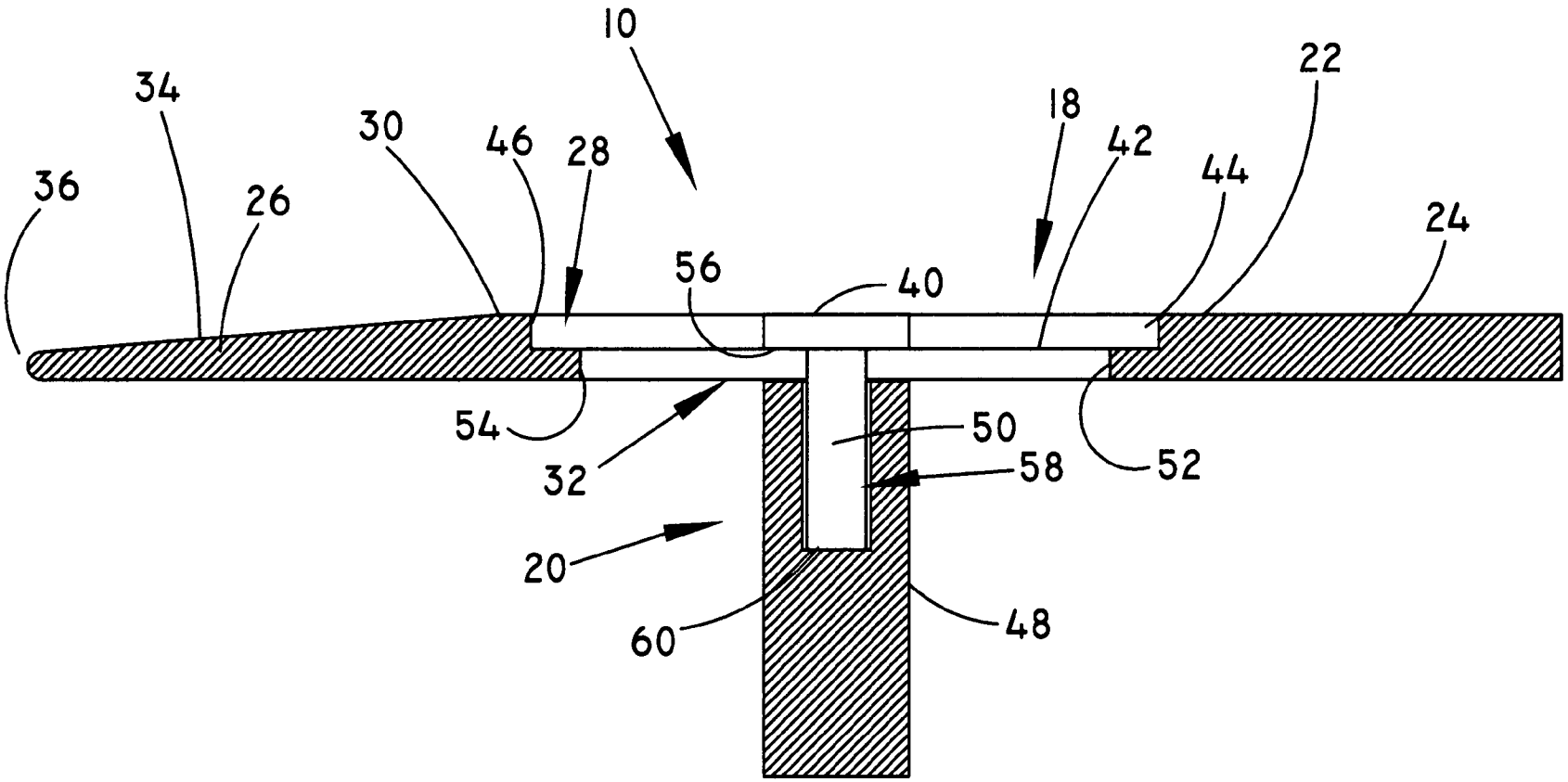
FIG. 4 is a cross-sectional side view of the mattress lift of the present invention.

As best shown in FIGS. 2 through 4, the mattress lift 10 comprises a lift device generally indicated as 18 and a lift support device generally indicated as 20.

The lift device 18 comprises a center or middle base or body 22 having a lift handle 24 formed or coupled to a proximal end portion thereof configured to be grasped by a user and a lift ramp 26 formed or coupled to a distal end portion thereof configured to slide between the bed mattress 12 and the box spring 16 to allow the user to lift the bed mattress 12 and to tuck the sheets or bed covers 14 therebetween.

The center or middle base or body 22 includes an elongated longitudinally disposed substantially oblong recess 28 formed in the upper surface 30 thereof and an elongated longitudinally disposed substantially oblong slot 32 formed through the center or middle base or body 22 and disposed beneath the elongated longitudinally disposed substantially oblong recess 28 in symmetrical registry or alignment therewith. The length or longitudinal dimension of the elongated longitudinally disposed substantially oblong slot 32 is less than the length or longitudinal dimension of the elongated longitudinally disposed substantially oblong recess 28.

The lift handle 24 comprises a reduced member to allow the user to grasp the lift handle 24 with the user's hand.

The lift ramp 26 comprises a ramp surface 34 inclined at angle A of substantially 6 degrees.

In addition, the distal tip 36 of the lift ramp 26 is convex to more smoothly insert the lift ramp 26 of the mattress lift 10 between the bed mattress 12 and the box spring or other support surface 16. The distal corners 38 of the lift ramp 26 are also convex to enhance insertion.

The overall length of the lift device 18 is at least 15 inches where the length of the center or middle base or body 22 is substantially 6.5 inches, the length of the lift handle 24 is substantially 4 inches and the length of the lift ramp 26 is substantially 5 inches. The width of the center or middle base of body 22 and the lift ramp 26 are substantially equal and substantially 3 inches. The lift handle 24 and the center or middle base of body 22 are substantially ¾ inches thick; while, the thickness of the lift ramp 26 decreases from substantially ¾ inches at a proximal end to substantially ¼ inches at a distal end thereof.

The lift support device 20 comprises an upper substantially circular or disk shaped member 40 disposed within the elongated longitudinally disposed substantially oblong recess 28 engaging the inner surface 42 thereof movable or slidable between a proximal end 44 and a distal end 46 thereof interconnected to a lower substantially cylindrical lift support member 48 disposed beneath the center or middle base of body 22 by an interconnecting member 50 at least partially disposed with the elongated longitudinally disposed oblong slot 32 movable or slidable between a proximal end 52 and a distal end 54 thereof. As shown in FIGS. 2 through 4, the interconnecting member 50 extends from the bottom or lower surface 56 of the upper substantially circular or disk shaped member 40 through the elongated longitudinally disposed substantially oblong slot 32 into a centrally disposed recess 58 to rest or engage the bottom thereof.

Figure 7:
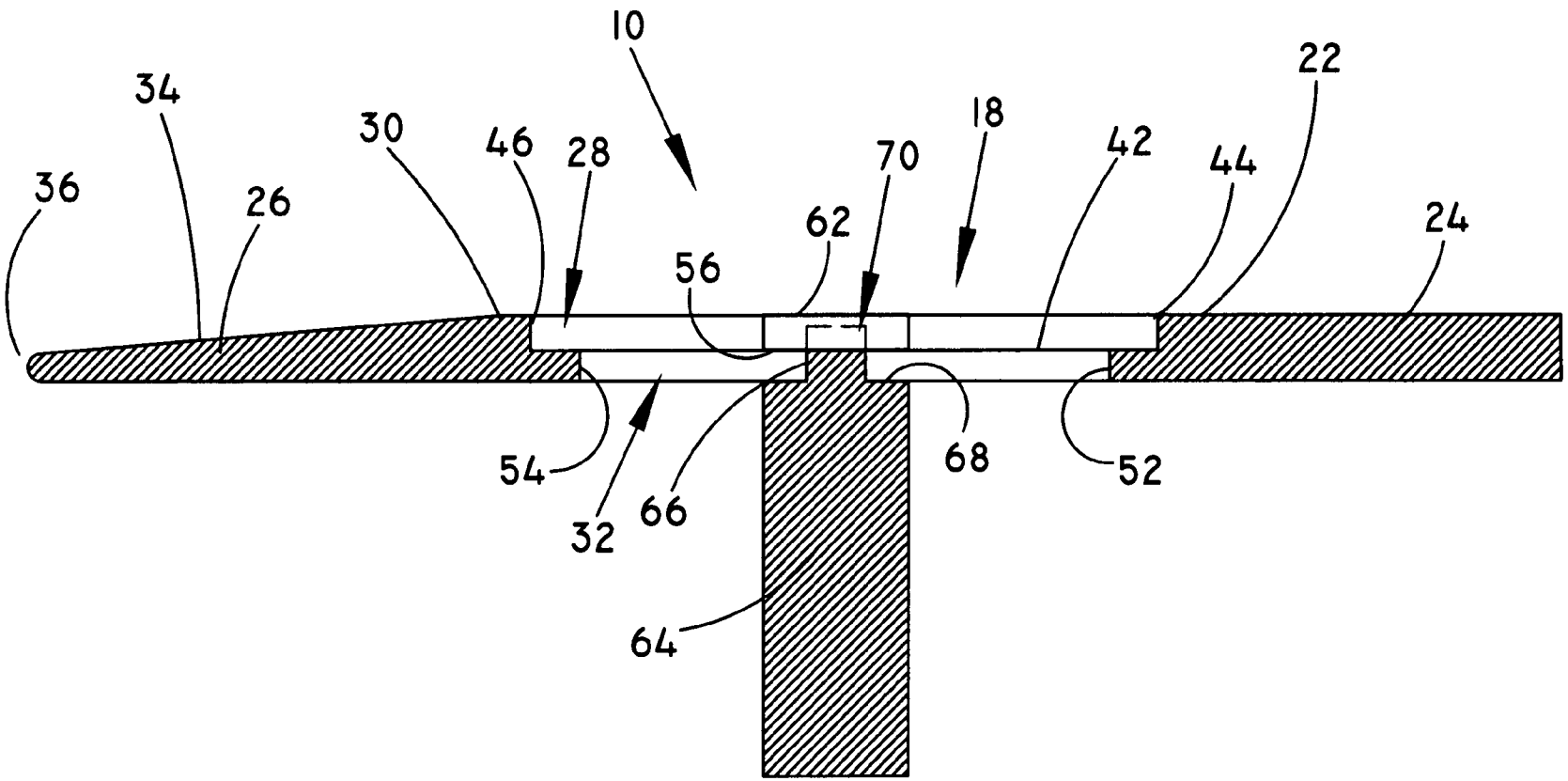
FIG. 7 is a cross-sectional side view of an alternate embodiment of the mattress lift of the present invention.

FIG. 7 shows an alternate embodiment of mattress lift 10 wherein the lift support device 20 comprises an upper substantially circular or disk shaped member 62 disposed within the elongated longitudinally disposed substantially oblong recess 28 engaging the inner surface 42 thereof movable or slidable between the proximal end 44 and distal end 46 thereof interconnected to a lower substantially cylindrical lift support member 48 disposed beneath the center or middle base of body 22 by an interconnecting member 50 at least partially disposed with the elongated longitudinally disposed oblong slot 32 movable or slidable between the proximal end 52 and the distal end 54 thereof. The interconnecting member 66 extends from the upper surface 68 of the lower substantially cylindrical lift support member 64 through the elongated longitudinally disposed oblong slot 32 into a centrally disposed recess 70 formed in the bottom of the substantially circular or disk shaped member 62.

Figure 1:
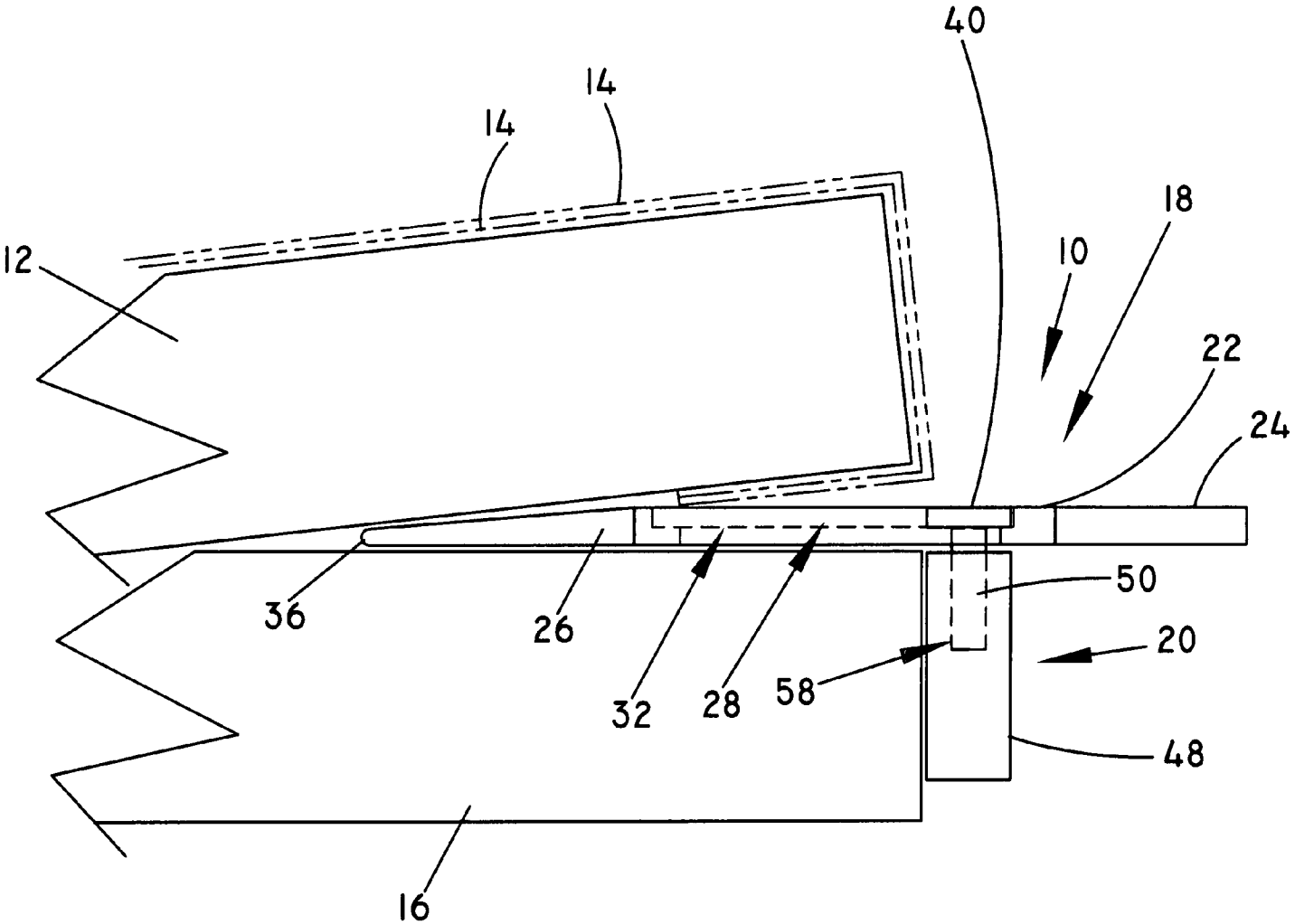
FIG. 1 is a side view of the mattress lift of the present invention inserted between a mattress and box spring.

In use, bed sheets or bed covers 14 are placed or positioned on top of the bed mattress 12. Once the bed sheets or bed covers 14 are positioned on the bed mattress 12, the user grasps the lift handle 24 and inserts the lift ramp 26 between the bed mattress 12 and box spring or other support surface 16 tucking the bed sheets or bed covers 14 therebetween as shown in FIG. 1.

Figure 5:
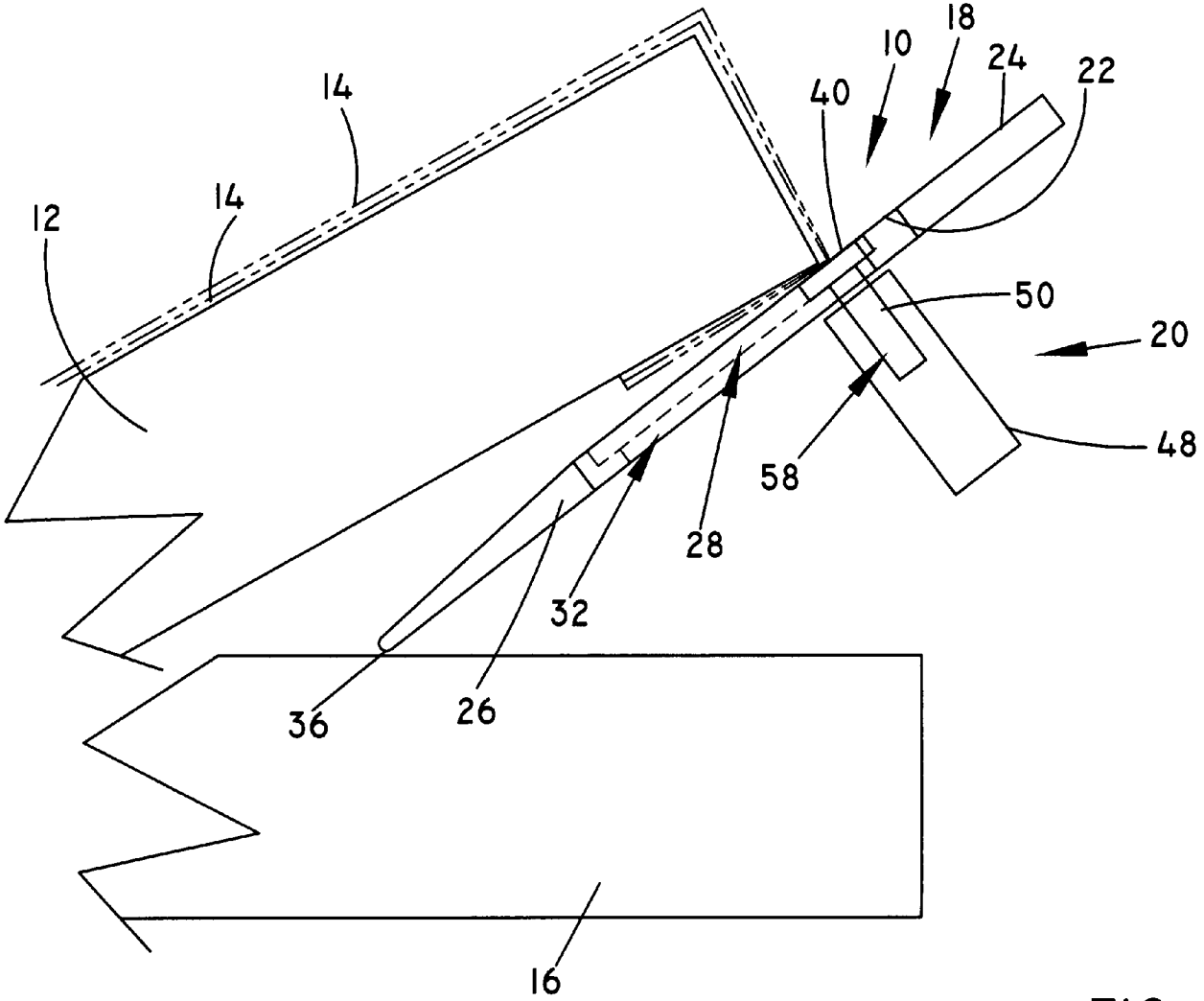
FIG. 5 is a side view of the mattress lift of the present invention with the mattress in an elevated position and the lift support device in the first position.
Figure 6:
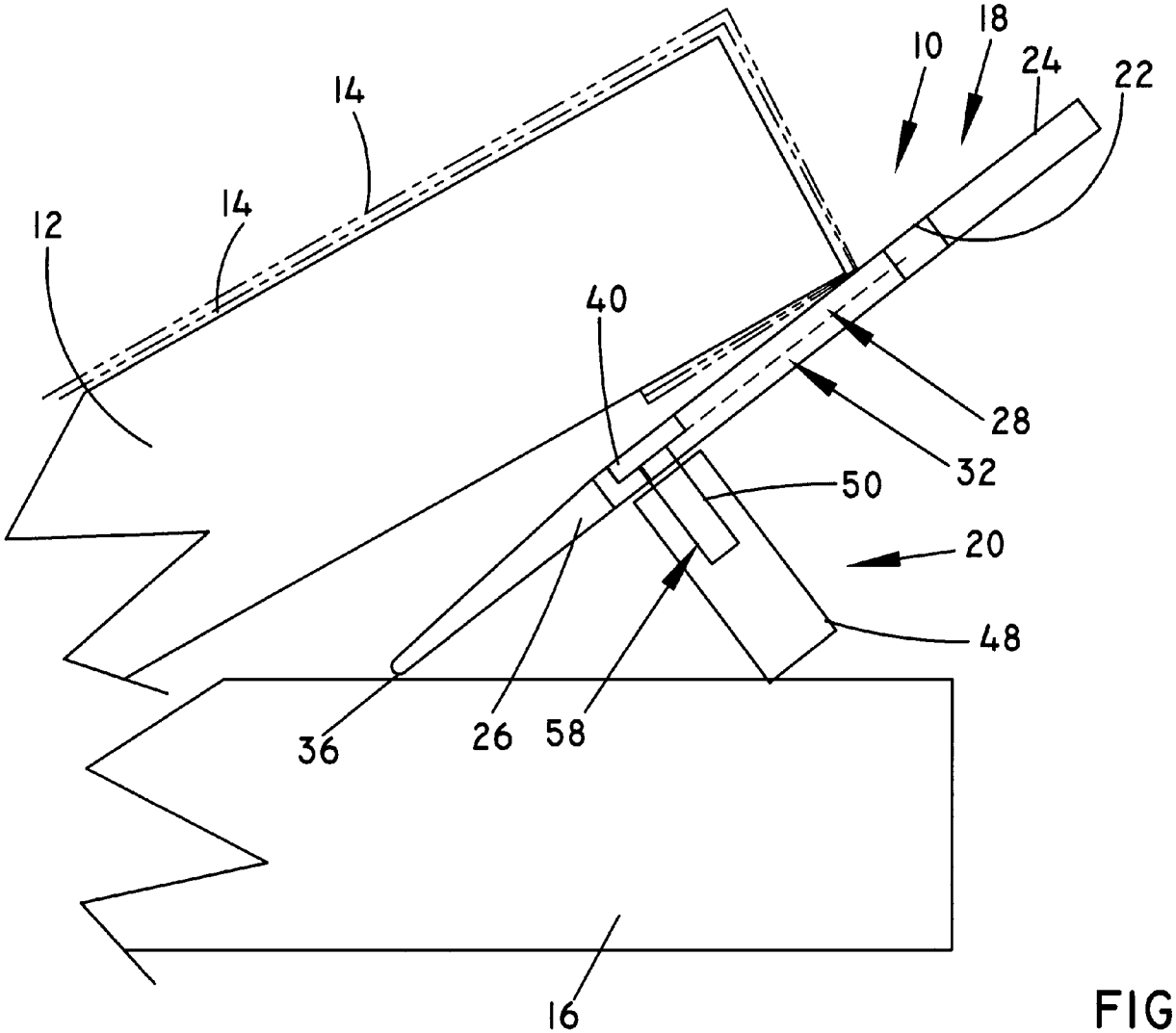
FIG. 6 is a side view of the mattress lift of the present invention with the mattress in an elevated position and the lift support device in the second position.

The mattress lift 10 is then lifted or rotated upwardly as shown in FIG. 5 while the lift support device 20 is located or positioned generally at the proximal end of the center or middle base or body 22. When the mattress lift 10 is in the elevated position, the lift support device 20 is moved or slid downwardly from the proximal end of the center or middle base or body 22 to the distal end 46 with the upper circular or disk shaped member 40 sliding along the elongated longitudinally disposed substantially oblong recess 28 and the interconnecting member 50 sliding within the elongated longitudinally disposed substantially oblong slot 32 as the lower substantially cylindrical lift support member 48 moves along the bottom of the lift support 20.

Once the lift support 20 reaches the distal end of the lift device 18 as the circular or disk shaped member 40 engages the distal end 46 of the elongated longitudinally disposed substantially oblong recess 28 and the interconnecting member 50 engages the distal end 54 of the elongated longitudinally disposed substantially oblong slot 32, the user releases the lift handle 24 of the mattress lift 10 allowing the lower substantially cylindrical lift support member 48 of the lift support 20 to rest on the box spring or support surface 16 to support the edge of the bed mattress 12 above the edge of the box spring or support surface 16 allowing the user to completely tuck in the bed sheets or bed covers 14.

Once complete, the lift support 20 is slid upwardly and the mattress lift 10 is removed or withdrawn from between the bed mattress 12 and the box spring or support surface 16.

In order to place and secure the sheets or bed covers 14 on a bed, the sheets or bed covers 14 are first tucked into one side of the bed mattress 12 and the box spring or other support surface 16 as described above, repeated on the opposite side of the bed, and finally repeated at the foot of the bed.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mattress lift for elevating a bed mattress and tucking in sheets or bed covers beneath or under the bed mattress between the bed mattress and a box spring or other supporting surface comprising a lift device including a base having a longitudinally disposed recess formed in the upper surface thereof with a longitudinally disposed slot formed in the base symmetrically disposed beneath said longitudinally disposed recess, a lift handle formed on the proximal portion of a base configured to be grasped by the user, a lift ramp including an inclined surface formed on an end distal portion of the base configured to slide between the bed mattress and the box spring or other supporting surface to tuck the sheets or bed covers therebetween and a lift support device including an upper lift coupler movably disposed within said longitudinally disposed recess interconnected to a lower lift support member disposed beneath the base by an interconnecting member at least partially disposed within said longitudinally disposed slot movable from a proximal end of said longitudinally disposed slot to a distal end of said longitudinally disposed slot to support said lift device in an elevated position to hold side edge portions and an end edge portion of the bed mattress in spaced relationship relative to the box spring or supporting surface.

2. A mattress lift for elevating a bed mattress and tucking in sheets or bed covers beneath or under the bed mattress between the bed mattress and a box spring or other supporting surface comprising a lift device including a base having a longitudinally disposed recess formed therein with a longitudinally disposed slot formed in the base symmetrically disposed beneath said longitudinally disposed recess, a lift handle formed on a proximal portion of the base configured to be grasped by the user, a lift ramp including an inclined surface formed on an end distal portion of the base configured to slide between the bed mattress and the box spring or other supporting surface to tuck the sheets or bed covers therebetween and a lift support device including an upper lift coupler movably disposed within said longitudinally disposed recess and a lower lift support member disposed beneath said base movable from a proximal end of said longitudinally disposed slot to a distal end of said longitudinally disposed slot to support said lift device in an elevated position to hold side edge portions and end an edge portion of the bed mattress in spaced relationship relative to the box spring or supporting surface.

3. The lift device of claim 2 wherein said base comprises a middle body including an elongated longitudinally disposed recess formed in the upper surface thereof and an elongated longitudinal slot formed through said middle body and disposed beneath said elongated longitudinally disposed recess in symmetrical registry or alignment therewith.

4. The lift device of claim 2 wherein said base comprises a middle body including an elongated longitudinally disposed substantially oblong recess formed in the upper surface thereof and an elongated longitudinally disposed substantially oblong slot formed through said middle body and disposed beneath said elongated longitudinally disposed substantially oblong recess in symmetrical registry or alignment therewith.

5. The lift device of claim 3 wherein the length of said elongated longitudinally disposed slot is less than the length of said elongated longitudinally disposed recess.

6. The lift device of claim 2 wherein said lift handle comprises a reduced member to allow the user to grasp the lift handle with the user's hand.

7. The lift device of claim 2 wherein said lift ramp comprises a ramp surface inclined at angle of substantially 6 degrees.

8. The lift device of claim 7 wherein the distal tip of said lift ramp is substantially convex.

9. The lift device of claim 8 wherein distal corners of said lift ramp are substantially convex.

10. The lift device of claim 2 wherein the distal tip of said lift ramp is substantially convex.

11. The lift device of claim 10 wherein distal corners of said lift ramp are substantially convex.

12. The lift device of claim 2 wherein the overall length of said lift device is at least 15 inches wherein the length of said base is substantially 6.5 inches, the length of said lift handle is substantially 4 inches and the length of the lift ramp is substantially 5 inches.

13. The lift device of claim 12 wherein said base and said lift ramp are substantially 3 inches in width.

14. The lift device of claim 13 wherein said lift handle and said base are substantially ¾ inches thick; while, the thickness of said lift ramp decreases from substantially ¾ inches at a proximal end to substantially ¼ inches at a distal end thereof.

15. The lift device of claim 3 wherein said lift support device comprises an upper member disposed within said elongated longitudinally disposed recess engaging the inner surface thereof movable between a proximal end and a distal end thereof coupled to a lower lift support member disposed beneath said base and movable between the proximal end and the distal end.

16. The lift device of claim 15 wherein an interconnecting member extends from the bottom portion of said upper member through said elongated longitudinally disposed slot to said lower lift support member.

17. The lift device of claim 2 wherein said lift support device comprises a upper member disposed within said elongated longitudinally disposed recess engaging the inner surface thereof movable between a proximal end and a distal end thereof coupled to a lower lift support member disposed beneath the base by an interconnecting member at least partially disposed within said elongated longitudinally disposed slot and movable between a proximal end and a distal end thereof.

18. A method of making a bed comprising the steps of placing bed sheets or bed covers on top of a bed mattress, grasping a lift handle and inserting a lift ramp between the bed mattress and a box spring surface, tucking the bed sheets or bed covers therebetween, elevating said lift handle and lift ramp upwardly while a lift support device is located or positioned at a proximal end of a base connected to the lift handle and the lift ramp, moving the lift support device downwardly from the proximal end of the base to a distal end of the base with a member of the lift support device sliding along a longitudinally disposed recess formed in the base, releasing the lift handle allowing the user to completely tuck in the bed sheets or bed covers, and repeating the process on an opposite side of the bed and then an end of the bed.

* * * * *